US005331686A

United States Patent [19]

Marshall

[11] Patent Number: 5,331,686

[45] Date of Patent: Jul. 26, 1994

[54] SINGLE USE SWEAT BAND

[76] Inventor: J. C. Marshall, P.O. Box 19, Smelterville, Id. 83868

[21] Appl. No.: 864,040

[22] Filed: Apr. 6, 1992

[51] Int. Cl.[5] ..... A41D 20/00

[52] U.S. Cl. ..... 2/181; 2/171.8; 2/181.6; 2/182.3; 2/174

[58] Field of Search ..... 2/181, 171, 171.2, 171.8, 2/181.2, 181.4, 181.6, 181.8, 182.3, 182.8, 182.1, 182.2, 174; 604/378, 384, 387, 396

[56] References Cited

U.S. PATENT DOCUMENTS

| | | | |
|---|---|---|---|
| 1,434,854 | 11/1922 | Stall | 2/171 |
| 1,633,586 | 6/1927 | Hunter | 2/171 |
| 1,697,919 | 1/1929 | Knepper | 2/171 |
| 2,016,210 | 10/1935 | Mann | 2/171 |
| 2,160,567 | 5/1939 | Sterne | 2/171 |
| 2,223,332 | 11/1940 | Sterne | 2/171 |
| 2,320,782 | 6/1943 | Larsen | 2/171 |
| 2,392,377 | 1/1946 | Golding | 2/171 |
| 2,700,977 | 2/1955 | Neerup | 2/171 |
| 2,783,474 | 3/1957 | Campagna et al. | 2/171 |
| 3,466,664 | 9/1969 | Militello | 2/171 |
| 4,394,782 | 7/1983 | Wasson | 2/181 |
| 4,502,156 | 3/1985 | Wishman | 2/181 |
| 4,502,156 | 5/1985 | Wishman . | |
| 4,521,922 | 6/1985 | Mitchell et al. | 2/171 |
| 4,638,512 | 1/1987 | Frankel | 2/171 |
| 4,656,671 | 4/1987 | Manges . | |
| 4,742,581 | 5/1988 | Rosenthal | 2/171 |
| 4,833,734 | 5/1989 | Der Estephanian | 2/181 |
| 4,856,116 | 8/1989 | Sullivan | 2/181 |
| 4,941,210 | 7/1990 | Konucik | 2/181.4 |
| 4,958,385 | 9/1990 | Rushton, Jr. | 2/181 |
| 5,025,504 | 6/1991 | Benston et al. | 2/181.4 |
| 5,033,122 | 7/1991 | Smith | 2/181 |
| 5,058,210 | 10/1991 | Tivis | 2/181 |
| 5,105,476 | 4/1992 | Cox | 2/181 |
| 5,119,513 | 6/1992 | McKay | 2/181 |

*Primary Examiner*—Clifford D. Crowder
*Assistant Examiner*—Gloria Hale
*Attorney, Agent, or Firm*—Keith S. Bergman

[57] ABSTRACT

A flat elongate sweat band having end portions releasably and adjustably fastenable to each other to form an annular configuration for use. The sweat band provides a thin tubular cover defining an internal chamber carrying a perspiration absorbing pad. The cover is compound with an annularly interior portion that is perspiration permeable and an annularly exterior portion that is perspiration impermeable which may carry patternation for aesthetic purposes or alphanumeric characters for advertising. One side of the cover carries an elongate strip of elastomeric material that shrinks after placement to provide elastic tension to aid positional maintenance of the band during use. The absorbent pad is formed of a mixture of linted fiber and water absorbing polymeres. The band structure particularly adapts the device for formation by continuous manufacturing processes which provide economic parameters allowing single use, throw away type use.

2 Claims, 1 Drawing Sheet

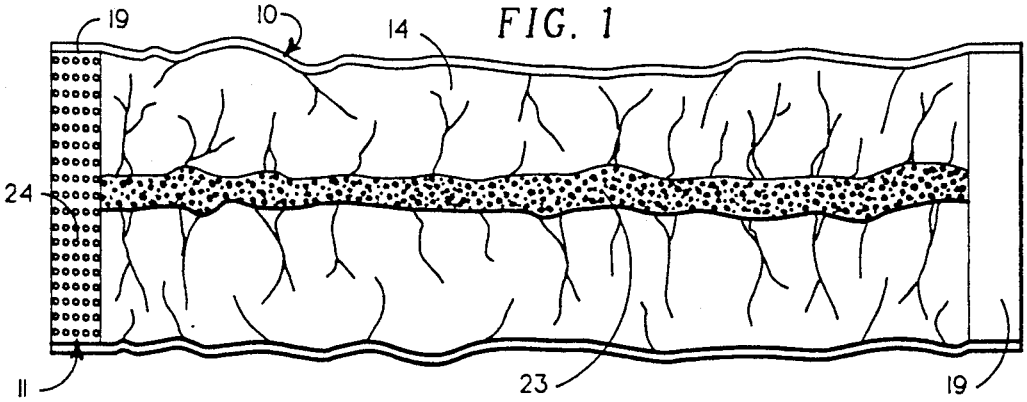
FIG. 1
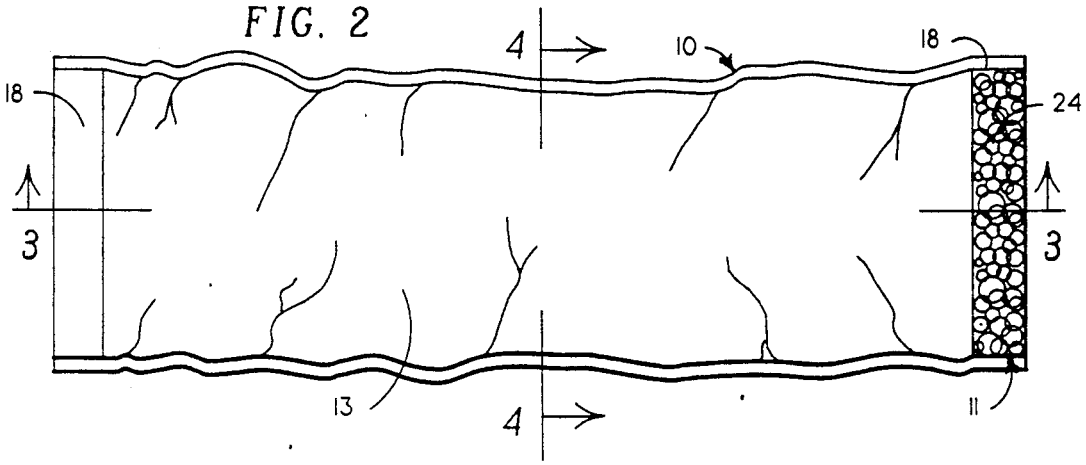
FIG. 2
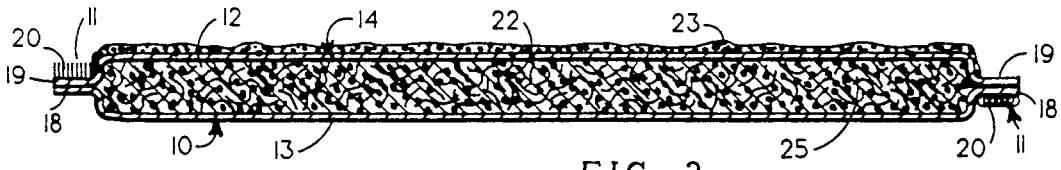
FIG. 3
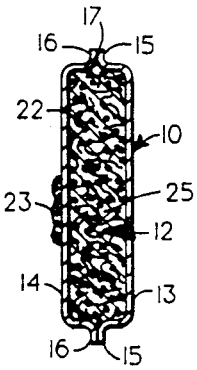
FIG. 4
FIG. 5
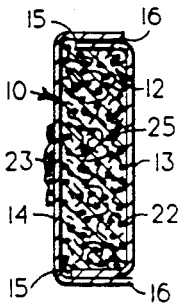
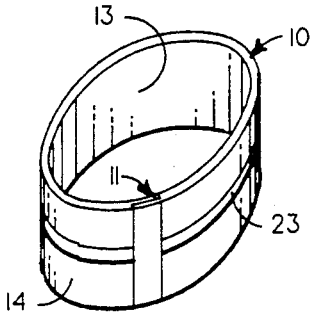
FIG. 6

SINGLE USE SWEAT BAND

BACKGROUND OF INVENTION

1. Related Applications

There are no applications related hereto heretofore filed in this or any foreign country.

2. Field of Invention

This invention relates generally to single use, releasably fastenable sweat bands, and more particularly to such a sweat band having a peripheral cover formed with a pervious inner side and an impervious outer side and carrying a pad of absorbing material.

3. Background and Description of Prior Art

Sweat bands have long been known and used on the extremities of the human body, and especially the head and arms, to absorb perspiration and prevent its flow on the body surface past the sweat band during periods of active exercise or exertion. Such bands in their simplest and primitive form merely provide an elongate piece of pervious material, such as absorbent cloth or paper, that is wrapped and releasably fastened about the body part being serviced. Such devices during their course of development have become more sophisticated to provide complex bands having plural element defining structures allowing formation by releasably fastening the ends of a flat band to each other with secondary structure providing elastically deformable means to aid positional maintenance. My invention provides a new, novel and improved device of this latter class.

Sweat bands generally provide a somewhat flattened bandlike structure configured for use as an annulus to provide surface contact of some substantial areal extent on the human body to allow them to more effectively fulfill their purposes. Some such bands are permanently formed in an annular configuration, but in general the more convenient type for placement is formed of flexible material with an elongate shape and with fastening means in their end portions to releasably connect the band ends to form an annulus of somewhat cylindrical configuration. This releasable type of fastening provides the added benefit of allowing an adjustable interconnection so that a band may be variously sized to allow a better fit upon a body portion and to allow a single band to be usable through a range of sizes. Many such known adjustably and releasably fastened bands, however, have not provided perspiration absorbing means about substantially their body contacting surface because of particular methods of formation or means for fastening. My sweat band solves this problem by providing a substantially homogeneous and continuous inner perspiration absorbing surface about substantially the entire body contacting area of the band.

Most known sweat bands have provided perspiration permeable material on both inner body contacting surface and outer exposed surface to allow perspiration to pass through the band and evaporate on its external surface. This evaporative function has commonly been required because the sweat band itself did not absorb and contain sufficient quantities of perspiration during a period of use and unless part of that accumulated perspiration were removed the band would cease to properly function. My invention in contradistinction provides a sweat band having a peripherally defined cover carrying perspiration absorbing material in its internal channel with a potentiality for absorption and containment of substantial amounts of perspiration, greater than will be developed during any continuous period of use of the device. This absorptive material is not configurationally stable as were paper and fabric sweat bands of the past, and therefore requires the particularized construction of my band providing an external casement, which distinguishes my band from prior devices. This particular structure allows my sweat band to be formed with different materials on its inner body contacting surface and its outer exposed surface, and the particular moisture absorbing material allows the outer surface to be formed of perspiration impervious material both of which features further distinguish my invention from prior sweat bands.

Sweat bands generally require some type of biasing to aid their positional maintenance and most have provided an elastically deformable material in their structure, commonly configured to extend in a circular band when in their annular mode. Such elastically deformable material has generally been created in the sweat band structure itself or has been a separate structure that is incorporated by sewing or other mechanical fastening. In either case, the structures generally have been complex and difficult of formation and have added disportionate expense to the general sweat band structure.

My invention in distinguishment provides a strip of elastomeric material carried by one surface of the tubular peripheral band cover. The material is an elastic polymere that may be applied in a viscous extrudable form to the surface of the cover to which it adheres for positional maintenance, but after a period of drying or curing contracts while yet maintaining adhesion, coherence and elasticity to pucker the cover carrying the material. This provides an elastomeric structure that will create a bias in a circular direction when the sweat band is placed about part of a body larger than the circumference of the band in its relaxed state. This type of elastomeric element provides a simple, inexpensive biasing means particularly adapted to mass production to further distinguishes my sweat band from those heretofore known.

Most prior sweat bands have been created for multiple use probably primarily because of their cost, though such use is not particularly desirable as various components of perspiration which they absorb remain in the bands to make multiple use physically, biologically and ascetically undesirable. The perspiration residues left in sweat bands commonly are odoriferous and often become more so after the lapse of time by reason of bacterial activity, oxidation and other chemical activity. Human perspiration also commonly contains various microbal agents which become resident in the sweat band where environmental conditions often are such as to encourage their growth and activity to create potential future hazards to health. Physically sweat bands often take a long period of time to dry after periods of use, if they ever do, and such moist sweat bands are generally not ascetically pleasing to a user at the time of a subsequent period of reuse. My invention solves these problems by providing a sweat band that is economically viable for single use.

My invention resides not in any one of these features per se, but rather in the synergistic combination of all of the structures of my sweat band that necessarily give rise to the functions flowing therefrom, as herein specified and claimed.

SUMMARY OF INVENTION

My invention provides a flat sweat band having end tabs with loop and pile fasteners at each end for adjustable fastening into an annular configuration about a human body part. The sweat band provides a relatively thin flexible peripheral cover defining an elongate channel closed in its end parts by the end tabs and carrying absorptive material comprising cotton lint and polyacrylonitrile grafted onto a starch substrata. The inner body contacting surface of the cover is formed of sweat permeable material and the outer exposed side is formed of sweat impermeable material which may carry patternation or alpha-numeric characters. One elongate surface of the cover carries a strip of elastic material that is placed in a viscous extrudable material that adheres to the cover and subsequently shrinks during curing while yet retaining its elasticity and adhesion to provide elastic biasing in the cover when placed in a tensive condition. The band is particularly designed for inexpensive mass production to allow single use on a human head or limbs. In providing such a sweat band, it is:

A principal object to create a sweat band that may be mass produced in an economically feasible fashion to allow single throw-away type use.

A further object is to provide such a sweat band that is formable from a flat band-like mode into an annular use mode by adjustably and releasably interconnecting its end portions.

A further object is to provide such a sweat band that has a flexible peripheral cover defining an internal channel and having an inner body contacting surface that is permeable to perspiration and an outer surface that is impermeable.

A further object is to provide such a sweat band that carries within the channel defined by the cover a perspiration absorbing material comprising a mixture of cotton lint and polyacrylonitrile grafted onto a starch substrata.

A further object is to provide such a band with one cover surface carrying a strip of elastomeric material that adheres to the cover and contracts after placement to pucker the cover while retaining its elasticity to allow stretching of the cover to provide tension in the stretch mode.

A still further object is to provide such a band that may carry patternation or alphanumeric information on its impervious outer surface.

A still further object of my invention is to provide such a sweat band that is of new and novel design, of rugged and durable nature, of simple and economic manufacture and otherwise well adapted for the uses and purposes for which it is intended.

Other and further objects of my invention will appear from the following specification and accompanying drawings which form a part hereof. In carrying out the objects of my invention, however, it is to be remembered that its accidental features are susceptible of change in design and structural arrangement with only one preferred and practical embodiment being illustrated in the accompanying drawings as is required.

BRIEF DESCRIPTION OF DRAWINGS

In the accompanying drawings which form a part of this specification and wherein like numbers of reference refer to similar parts throughout:

FIG. 1 is an orthographic surface view of the outer exposed surface of my sweat band showing its various parts, their configuration and relationship.

FIG. 2 is an orthographic surface view of the inner body-contacting surface of the sweat band of FIG. 1.

FIG. 3 is an elongate cross-sectional view through the sweat band of FIG. 2, taken on the line 3—3 thereon in the direction indicated by the arrows.

FIG. 4 is a transverse cross-sectional view through the sweat band of FIG. 2, taken on the line 4—4 thereon in the direction indicated by the arrows.

FIG. 5 is a cross-sectional view of a second species of overlapping seam that may be used to join the adjacent edge portions of the cover elements, taken at a point similar to that of FIG. 4.

FIG. 6 is a somewhat reduced isometric view of my sweat band formed into an annular mode for use.

DESCRIPTION OF THE PREFERRED EMBODIMENT

My sweat band generally provides elongate tubular cover 10 having fastenable end structure 11 and carrying perspiration absorbing material 12 in its internal channel.

Tubular cover 10 is an elongate band-like element of generally rectilinear configuration formed by an inner surface element 13 and outer surface element 14, each of similar configuration and structurally joined to the other at adjacent edges. Elongate side edge portions 15 of the inner surface element and adjacent side edge portions 16 of the outer surface element preferably overlap in either an abutting relationship as illustrated in FIG. 4 or an overlapping relationship as illustrated in FIG. 5. The adjacent surfaces of edge portions 15, 16 are structurally joined to each other by known methods depending upon the nature of the material, such as by sewing, adhesion, electronic welding or the like. The method of joinder of these elements should be such as not to create undue stiffness or lack of flexibility in the finished product. The two side elements 13 and 14 thusly joined form an elongate peripherally defined tubular structure defining a similarly configured internal channel for containment of absorbent material.

The opposed shorter ends 17 of the inner surface element and ends 18 of the outer surface element are joined in butt-type joint 20 by mechanical interconnection of the adjacent portions of these elements. Generally this butt-type joint will have some length to provide an outwardly extending end tab structure which may be used to fasten the two end tab structures together to form an annular band as hereinafter described. With the adjacent ends of the surface elements thusly joined, the channel defined by the side joinder becomes chamber 22 for containment of absorbing material.

At least one surface of one of the surface elements of the tubular cover carries an elongate strip of biasing material 23. This biasing material may be on one or more of the inner or outer sides of either inner surface element 13 or outer surface element 14, and it may be variously positioned on that surface. Preferably the biasing material is medially positioned in a strip substantially parallel to elongate sides 15, 16 of one side of the element supporting it, and for ease of manufacture the material preferably is carried on the outer side of the outer surface element 14.

The purpose of the biasing material is to contract the tubular casement to a length less than its normal constructed length, but yet under appropriate tension allow elastic extension of the element to substantially its normal constructed length to aid in positionally maintaining the band when placed about a body part. The biasing material 23 may include various known elastomeric materials such as latex, synthetic elastomeres or similar substances formed as separate elements and mechanically attached to my band by adhesion, stitching or similar process, and various pucker-type stitching with either elastic or non-elastic thread, would also be within the scope of my invention.

The preferred biasing material is a curable elastic polymeric material that may be applied in a viscous extrudable state to cover 10. The material adheres to the cover surface and during subsequent curing shrinks to some degree, but yet cures to a state that is cohesive with elastomeric properties sufficient to allow the material to be expanded to its original placement length without physical damage. Various of such materials have heretofore become known for purposes similar to those for which biasing material 23 is used in my invention. The material that I have found suited for this purpose and that which I prefer is one merchandised under the trade name and style MELTECK by the Meltech Corporation which has an office in Baroda, Mich. This material is available in the present day marketplace, is of an economically viable nature and allows simple and easy formation and manufacturing processes to provide a sweat band of a single use throw-away type.

Fastenable end structure 11 is shown particularly in the cross-sectional view of FIG. 3. The adjacent end portions 18, 19 of inner and outer cover elements 13, 14 respectively are attached to each other by mechanical means. In production, it may be simpler to allow some absorbing material 12 to exist between the two end portions 18, 19 and this is within the scope of my invention as long as the end portions are fastened sufficiently to each other to define chamber 22. The end tab structure 18, 19 must have some length, that is the distance that it extends from the portion of tubular cover 10 whereat chamber 22 is defined, but the absolute length is not critical. For effective use tab length should be related to the amount of potential elongate elastic deformation of the tubular cover and the amount of adjustable sizing desired for a particular sweat band. Commonly this length will be in approximately one-half to one inch range. It should be remembered, however, that the sweat band will not have so great a potential for absorbing moisture in the tab structure as in its body area between the tab structures, so the tabs should not be larger than necessary.

At least one side of each tab structure 18, 19 provides fastening means 24 to allow releasable fastening of the tab structures to each other to establish and maintain the band in an annual configuration. It is generally desired that a sweat band provide a cylinder-like configuration, as opposed to a Mobius type configuration, and this requires that the fastening elements at opposite ends be on opposite sides of the tab structures as illustrated in FIG. 3. The fastening means may comprise various adhesives or mechanical fasteners such as buttons, hooks and the like, but the preferred fastener is of the fabric hook and loop type. It is possible that fastening elements may be positioned on both sides of each end tab structure, but this commonly is not necessary or even desirable. The length of the two tab elements will allow some measure of adjustability in the size of the band when formed into an annulus and may be varied to meet individual needs.

The size and configuration of my sweat band is somewhat critical and essentially related to its function. The length of the band, that is the distance between end tab structures, must be such that when the tubular cover is in relaxed condition this length is less than the circumference of the body member which is to carry the sweat band, but in tensioned condition must also be at least as long as the circumference of the body part that is to carry the band. Some variance is allowed in either of these dimensions by reason of the nature of end tab structures which allows variable positioning of the ends of the cover relative to each other when the band is formed into an annular configuration. Such dimensioning allows a sweat band to be positionally maintained on a body part by elastic resilience in the band.

The width of my sweat band, that is the distance between elongate sides 15, 16, is not critical but should be sufficient to allow the absorption of perspiration presented to it and prevent passage of perspiration across the band while yet not being greater than necessary for this purpose so as to be uncomfortable to a wearer or hinder his physical activities. Commonly for a head band the length will vary from about eighteen to twenty-four inches and the width will vary from one to four inches. The length of arm or leg bands will vary according to the portion of an arm or leg which they are to encompass, but generally will be in the six to eight inch range and the width of such bands will be substantially the same as in head bands.

The material from which cover 10 is formed is also critical to my invention. The inner surface element 13 is formed of material pervious to human perspiration and the outer surface element is formed of material impervious to that perspiration. The inner surface element may be formed from materials that are themselves pervious, such as various animal or vegetable fibers or from moisture impervious materials that provide a structure with holes, pores, voids, channels or the like that allow permeation. Cotton cloth is a typical example of the first type of material while various sheet plastic or polymeric materials which have perforations or are of woven form are examples of the latter class. The outer surface element is formed from polymeric or resinous sheet plastic materials that do not define porosity of any significance. The material from which both inner and outer surface elements of the tubular cover is formed must also be of a reasonably flexible, deformable nature and must possess appropriate strength and durability to serve the purposes required of it.

Perspiration absorbing material 12 receives perspiration permeating inner surface element 13 and retains and stores this perspiration. The absorbing material must have the potentiality to contain reasonable amounts of perspiration, since the outer surface of my sweat band is impermeable and contained perspiration cannot pass through the outer surface of the sweat band for evaporation during use. Various known absorptive materials that are wetted by perspiration fulfill this purpose, but that which is preferred is a mixture of vegetable fibers of relatively small mass and volume and a chemical material that may absorb sufficient water to ultimately swell to form a gel or colloid. Preferably the mixture comprises cotton lint and the material commonly known as Polysorb, which is a polyacrylonitrile grafted onto a starch substrata pursuant to the teachings of U.S. Pat. No. 4,054,387. The name Polysorb for this material is a trademark of Polysorb, Inc., of Smelterville, Id., which manufactures the material. The proportions of fiber and Polysorb may vary from substantially all of one material to substantially all of the other material, but the preferred mixture is approximately ten percent by weight of Polysorb and the balance of fiber. In general, the greater the proportion of Polysorb, the greater will be the absorptive capacity of the mixture.

This absorptive material may be placed within chamber 22 in the form of a loose, dry mixture or preferably may be formed as a mat to better maintain a flat band-like configuration of my sweat band. The linted Polysorb mixture may readily be formed into a matted structure by adding small amounts of moisture to the mixture and subsequently drying it in the configuration ultimately desired. This type of absorptive material lends itself to continuous manufacturing processes and contributes to the economic viability of my sweat band to allow its use as a throw-away type device for single use.

Manufacturing of the band may be accomplished by continuous processes wherein the product is created in continuous lengths with the perspiration absorbing material 12 being established within the tubular cover 10 during the process of formation. The continuous band then may be cut to desired lengths and the end elements mechanically pressed together and fastened to form tab structures. The biasing material 23 is established in an elongate strip by extrusion, and may serve as an adhesive or cement the interconnection of adjacent ends 18 and 19 that form end tabs.

Having thusly described the structure of my invention, its use may be understood.

A sweat band is formed according to the foregoing specification, by known continuous manufacturing processes. The various parameters of the sweat band are determined by known engineering methods to meet the conditions of particular use. The band length is regulated to allow some bias in the element when formed into an annulus and positioned about the body part where it is to be used. Inner surface element 13 is chosen to have sufficient permeability to allow passage of perspiration from the covered body surface without allowing transport of such perspiration along that covered surface. The amount of absorbing material 25 is chosen in consideration of the absorbency of the material being used so that that material will absorb perspiration that will be presented to a sweat band during a period of use. This normally will require a filling of a mixture of approximately three-fourths by weight of cotton lint and one-fourth by weight of Polysorb of approximately one-quarter inch thickness. This type of sweat band will generally absorb perspiration presented to the device during a period of a day of ordinary exertive activity.

For use, such a sweat band is positioned on a body extremity in an annular configuration and in a biased condition for positional maintenance. Positioning may be accomplished either by releasably fastening the two band ends together and then positioning the band by tensioning it or by positioning the band as an elongate structure, wrapping it around a body part and then fastening the two ends together with appropriate tension in the band. The only thing critical to the placement is the configurational relationship of the device in place with some tension upon the human body.

It is to be noted that in the placement process the size of the annulus formed by the structure may be somewhat varied by positioning the end tab structures in different relationship to each other, so long as those structures form a releasably fastenable connection of such strength as is required to positionally maintain the device.

It is further to be noted that the sweat band might be used on any portion of the body about which the band may be wrapped in a fastenable configuration and positionally maintained. The positioning may be about the arms or legs, most commonly about the head, and even possibly about the trunk, if the sweat band be there desired. Bands having appropriate parameters for such positioning and use are all within the scope of my invention.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. An elongate sweat band releasably formable into an annular mode for positional maintenance on a portion of the human body to absorb and prevent the passage of perspiration, comprising in combination:

an elongate flexible cover having configurationally similar first and second substantially rectilinear surface elements with longer side edges of the first inner surface element structurally joined to the longer side edges of the second outer surface element and adjacent surfaces of shorter end portions of each surface element joined to form opposed end tabs and to define an enclosed chamber, the first inner surface element being permeable to perspiration and the second outer surface element being impermeable to perspiration, and a strip of elastic material adherent to and extending between the opposed end tabs on at least one surface element of the cover, said elastic material being placeable in extrudable form and shrinkable upon curing to create tension in the surface element supporting it when that surface element is in extended condition, to aid positional maintenance of the sweat band;

fastening means carried by opposite sides of each end tab to releasably fasten the opposed end tabs to each other to form an annular cylinder-like structure; and absorbing material carried within the chamber defined by the cover to absorb perspiration comprising absorbent fibers admixed with perspiration absorbing particulate material.

2. An elongate sweat band releasably formable into an annular mode for positional maintenance on a portion of the human body to absorb and prevent the passage of perspiration, comprising in combination:

an elongate flexible cover having first inner and second outer surface elements of similar rectilinear configuration, with longer side edges of the first inner surface element joined to the longer side edges of the second outer surface element and the adjacent surfaces of the shorter end portions of each surface element joined to form opposed end tabs so that the cover defines an enclosed chamber, the first inner surface element formed of perspiration permeable fabric material and the second outer surface element formed of sheet plastic material impermeable to perspiration, and the outer surface element of said cover carrying a band of elastic material positioned medially between the longer side edges and adhered to said outer surface element, said elastic material being placeable in an extrudable form and shrinkable upon curing to create tension in the cover when in extended condition;

hook and pile fastening means carried by opposite sides of each end tab to releasably fasten the opposed end tabs to each other to form an annular cylinder-like structure; and absorbing material carried in the chamber defined by the cover to absorb perspiration, said absorbing material comprising cotton lint admixed with up to thirty percent by weight of polyacrylonitrile grafted onto a starch substrata.

* * * * *